US009066390B2

(12) United States Patent
Cheng et al.

(10) Patent No.: US 9,066,390 B2
(45) Date of Patent: Jun. 23, 2015

(54) LED DRIVING APPARATUS HAVING HOLDING CURRENT CIRCUIT AND OPERATING METHOD THEREOF

(71) Applicant: Raydium Semiconductor Corporation, Hsinchu (TW)

(72) Inventors: Chung-Tai Cheng, Zhubei (TW); Chia-Hsiu Lin, Hsinchu (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 25 days.

(21) Appl. No.: 14/053,262

(22) Filed: Oct. 14, 2013

(65) Prior Publication Data

US 2014/0111107 A1 Apr. 24, 2014

(30) Foreign Application Priority Data

Oct. 19, 2012 (TW) ..... 101138700 A

(51) Int. Cl.
*H05B 33/08* (2006.01)

(52) U.S. Cl.
CPC ..... *H05B 33/0809* (2013.01)

(58) Field of Classification Search
CPC ..... H05B 33/0821; H05B 33/00; H05B 33/0809; H05B 33/08; H05B 33/0806; H05B 33/0815
USPC ..... 315/200 R
See application file for complete search history.

(56) References Cited

U.S. PATENT DOCUMENTS

| | | | | |
|---|---|---|---|---|
| 4,215,278 | A * | 7/1980 | Barbier et al. | 307/116 |
| 4,890,043 | A * | 12/1989 | Davie | 315/408 |
| 2007/0024211 | A1* | 2/2007 | Rimmer et al. | 315/291 |
| 2011/0080110 | A1* | 4/2011 | Nuhfer et al. | 315/291 |
| 2012/0038285 | A1* | 2/2012 | Leung et al. | 315/193 |

* cited by examiner

*Primary Examiner* — Tuyet Vo
*Assistant Examiner* — Henry Luong

(57) ABSTRACT

A LED driving apparatus having a holding current circuit and an operating method thereof are disclosed. The holding current circuit includes an input terminal, a holding resistor, a regulator, a first resistor, a second resistor, a setup resistor, a control unit, and a transistor. The holding resistor and the regulator, the first resistor and the second resistor, and the transistor and the setup resistor are coupled between the input terminal and ground terminal respectively. The control unit is coupled to the transistor, between the holding resistor and the regulator, and between the first resistor and the second resistor respectively. The control unit receives a first voltage between the holding resistor and the regulator and a second voltage between the first resistor and the second resistor and outputs a control signal to selectively control the transistor off.

5 Claims, 8 Drawing Sheets

LED DRIVING APPARATUS HAVING HOLDING CURRENT CIRCUIT AND OPERATING METHOD THEREOF

BACKGROUND OF THE INVENTION

1. Field of the Invention

The invention relates to the driving of a light-emitting diode (LED); in particular, to a LED driving apparatus having a holding current circuit and operating method thereof.

2. Description of the Related Art

Please refer to FIG. 1 and FIG. 2. FIG. 1 illustrates a schematic diagram of a conventional tri-electrode AC switch (TRIAC) circuit; FIG. 2 illustrates a schematic diagram of the tri-electrode AC switch circuit of FIG. 1 being applied in a lighting circuit. As shown in FIG. 1 and FIG. 2, the tri-electrode AC switch TRIAC is a gate-controlled switch and it is also called "bidirectional triode thyristor" and can be conducted in both the forward voltage and the reverse voltage. When the tri-electrode AC switch circuit 1 is applied in a lighting product, the tri-electrode AC switch circuit 1 can adjust the lightness of the lighting product by changing the resistance of the variable resistor R1. When the AC voltage passes through the tri-electrode AC switch circuit 1, the tri-electrode AC switch circuit 1 changes the resistance of the variable resistor R1 to adjust the voltage conduction angle to change the lightness of the lighting product correspondingly.

However, as to current LED products, if the tri-electrode AC switch circuit 1 is added as shown in FIG. 2, because the tri-electrode AC switch circuit 1 is unstable under low-voltage and low-current condition, the input voltage $V_{IN}$ will be also unstable at low-voltage conduction angle, and different voltage forms VS1 and VS2 will be formed as shown in FIG. 3B. If the input voltage $V_{IN}$ is zero at low-voltage conduction angle, the LED apparatus 24 will even flicker.

One solution is to add a holding current circuit 20 in the lighting circuit 2. FIG. 4 shows an embodiment of a conventional holding current circuit 20. As shown in FIG. 4, a resistor $R_H$ is disposed between the input voltage $V_{IN}$ and the regulator REG, and the gate of the transistor MOS is coupled between the resistor $R_H$ and the regulator REG. The regulator REG will generate a voltage $V_F$, and the voltage at the setting resistor $R_{SET}$ will approach the voltage $V_F$, therefore, a current can be formed by adjusting the resistance of the setting resistor $R_{SET}$. This current can be used as the holding current in the lighting circuit 2 to make the input voltage $V_{IN}$ stable at low-voltage conduction angle, and the same voltage forms VS1' and VS2' will be formed as shown in FIG. 3C.

However, the conventional holding current circuit 20 applied in the lighting circuit 2 having the tri-electrode AC switch TRIAC will also cause serious problems of high power consumption and over-heat of the light product since the higher the voltage, the larger the power consumption. In addition, because the current and the voltage of the current source circuit 22 disposed under the LED apparatus 24 will become larger, the power consumption P of the current source circuit 22 will be excessive (as shown in FIG. 5B); therefore, the over-heat problem is needed to the overcome.

Therefore, the invention provides a LED driving apparatus having a holding current circuit and operating method thereof to solve the above-mentioned problems occurred in the prior arts.

SUMMARY OF THE INVENTION

An embodiment of the invention is a LED driving apparatus having a holding current circuit. In this embodiment, the holding current circuit of the LED driving apparatus includes an input terminal, a holding resistor, a regulator, a first resistor, a second resistor, a setup resistor, a control unit, and a transistor. The holding resistor and the regulator, the first resistor and the second resistor, and the transistor and the setup resistor are coupled between the input terminal and ground terminal respectively.

The control unit is coupled to the transistor, between the holding resistor and the regulator, and between the first resistor and the second resistor respectively. The control unit receives a first voltage between the holding resistor and the regulator and a second voltage between the first resistor and the second resistor and outputs a control signal to selectively control the transistor off.

Another embodiment of the invention is a method of operating a LED driving apparatus having a holding current circuit. In this embodiment, the holding current circuit includes an input terminal, a holding resistor, a regulator, a first resistor, a second resistor, a setup resistor, a control unit, and a transistor. The holding resistor and the regulator are coupled in series between the input terminal and a ground terminal. The first resistor and the second resistor are coupled in series between the input terminal and the ground terminal. The transistor and the setup resistor are coupled in series between the input terminal and the ground terminal. The control unit is coupled to the transistor, between the holding resistor and the holding resistor, and between the first resistor and the second resistor respectively.

The method includes steps of: (a) the control unit receiving a first voltage between the holding resistor and the regulator and a second voltage between the first resistor and the second resistor and outputting a control signal; and (b) selectively switching off the transistor according to the control signal.

Compared to the prior art, the LED driving apparatus having the holding current circuit and operating method thereof disclosed by the invention can achieve following effects of: (1) maintaining the input voltage $V_{IN}$ stable at low-voltage conduction angle to prevent the flickering of the LED apparatus; (2) effectively solving the problems of high power consumption and over-heat when the input voltage $V_{IN}$ is excessive in prior arts.

The advantage and spirit of the invention may be understood by the following detailed descriptions together with the appended drawings.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

An embodiment of the invention is a LED driving apparatus having a holding current circuit. In this embodiment, the LED driving apparatus is used to drive the LED to emit lights, but not limited to this. The LED driving apparatus includes a TRIAC circuit. In the LED driving apparatus, when the AC voltage passes through the TRIAC circuit, the TRIAC circuit can change the resistance of the variable resistor to adjust the voltage conduction angle to change the lightness of the lighting product correspondingly.

Figure 6:
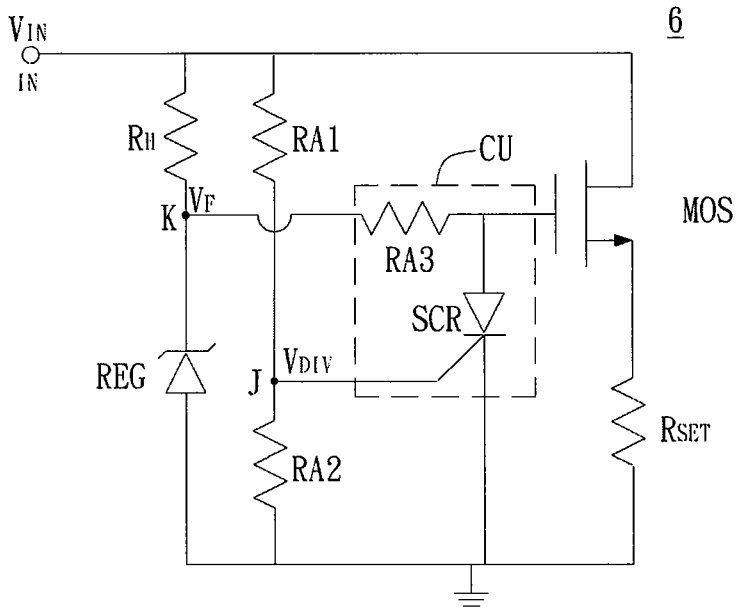
FIG. 6 illustrates a schematic diagram of the holding current circuit of the LED driving apparatus in an embodiment of the invention.

Please refer to FIG. 6. FIG. 6 illustrates a schematic diagram of the holding current circuit of the LED driving apparatus in this embodiment. As shown in FIG. 6, the holding current circuit 6 of the LED driving apparatus includes an input terminal IN, a holding resistor $R_H$, a regulator REG, a first resistor RA1, a second resistor RA2, a third resistor RA3, a setup resistor $R_{SET}$, a transistor MOS, and a rectifier SCR. It should be noticed that the third resistor RA3 and the rectifier SCR are disposed in a control unit CU. The input terminal IN has an input voltage $V_{IN}$. Wherein, the transistor MOS can be a metal-oxide-semiconductor field-effect-transistor (MOSFET); the rectifier SCR can be a silicon controlled rectifier (SCR), but not limited to this.

The resistor $R_H$ and the regulator REG are coupled in series between the input voltage $V_{IN}$ and the ground terminal. The first resistor RA1 and the second resistor RA2 are coupled in series between the input voltage $V_{IN}$ and the ground terminal. The transistor MOS and the setup resistor $R_{SET}$ are coupled in series between the input voltage $V_{IN}$ and the ground terminal. One end of the third resistor RA3 is coupled to the gate of the transistor MOS and the other end of the third resistor RA3 is coupled to a node K between the holding resistor $R_H$ and the regulator REG. The node K has a voltage $V_F$. The anode of the rectifier SCR is coupled between the third resistor RA3 and the gate of the transistor MOS; the cathode of the rectifier SCR is coupled to the ground terminal; the gate of the rectifier SCR is coupled to a node J between the first resistor RA1 and the second resistor RA2. The node J has a divided voltage $V_{DIV}$ formed by the first resistor RA1 and the second resistor RA2 dividing the input voltage $V_{IN}$.

Figure 1:
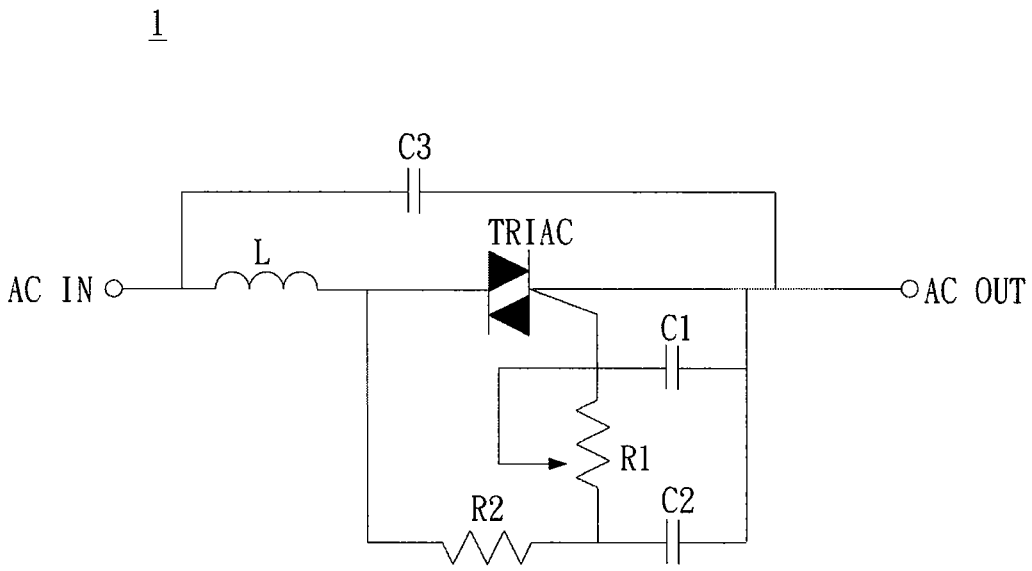
FIG. 1 (PRIOR ART)
FIG. 1 illustrates a schematic diagram of a conventional tri-electrode AC switch (TRIAC) circuit.
Figure 2:
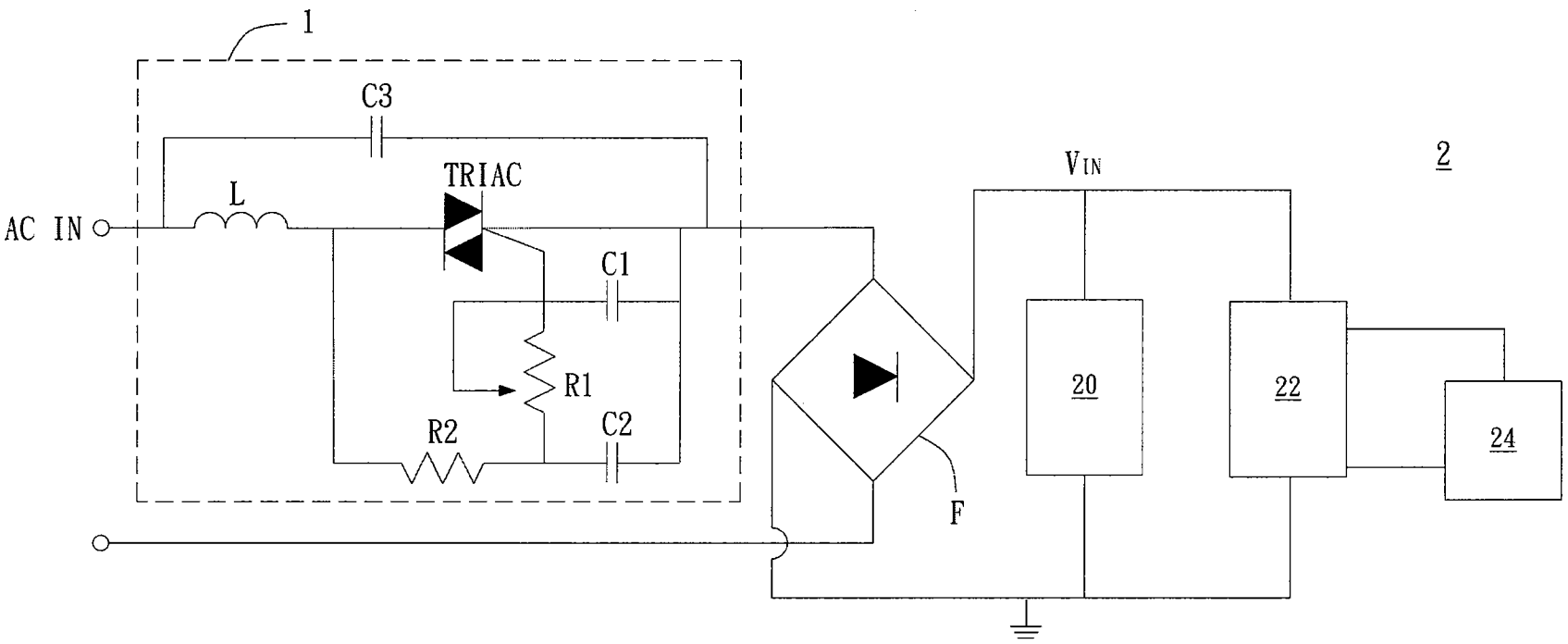
FIG. 2 (PRIOR ART)
FIG. 2 illustrates a schematic diagram of the tri-electrode AC switch circuit of FIG. 1 being applied in a lighting circuit.
Figure 3A:
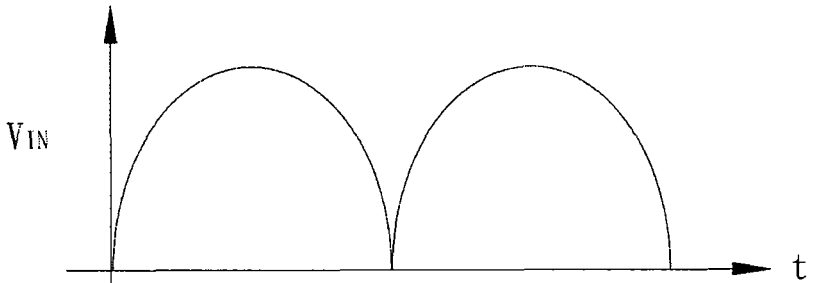
FIG. 3A (PRIOR ART)
FIG. 3A illustrates a wave-form diagram of the input voltage.
Figure 3B:
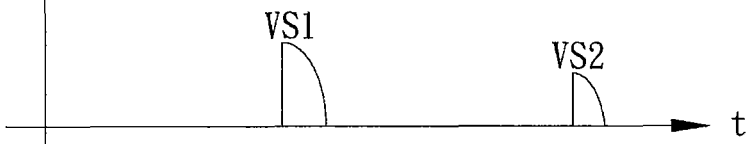
FIG. 3B (PRIOR ART)
FIG. 3B illustrates a wave-form diagram of the unstable voltage caused by the TRIAC circuit.
Figure 3C:
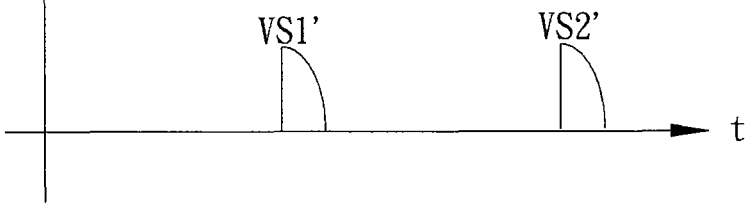
FIG. 3C (PRIOR ART)
FIG. 3C illustrates a wave-form diagram of the stable voltage maintained by the holding current circuit.
Figure 4:
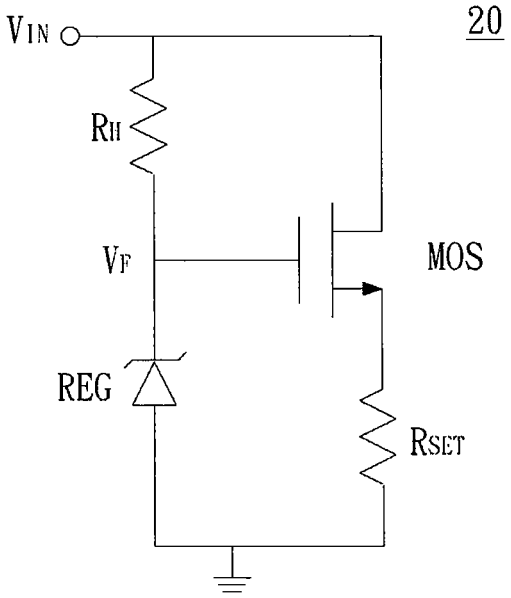
FIG. 4 (PRIOR ART)
FIG. 4 illustrates an embodiment of the conventional holding current circuit.
Figure 5A:
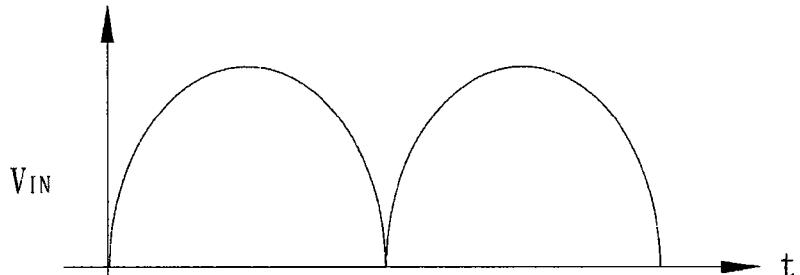
FIG. 5A (PRIOR ART)
FIG. 5A illustrates a wave-form diagram of the input voltage.
Figure 5B:
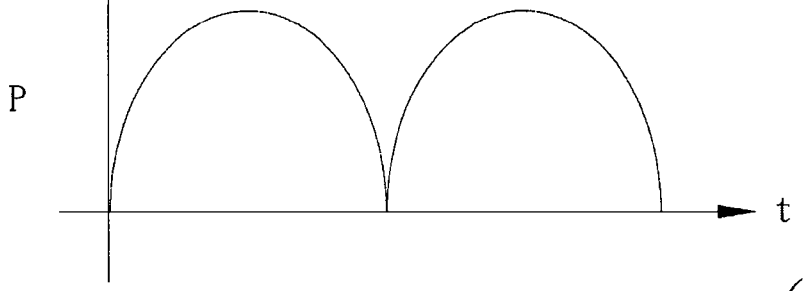
FIG. 5B (PRIOR ART)
FIG. 5B illustrates a schematic diagram of the excessive power consumption when the conventional holding current circuit is used.
Figure 7:
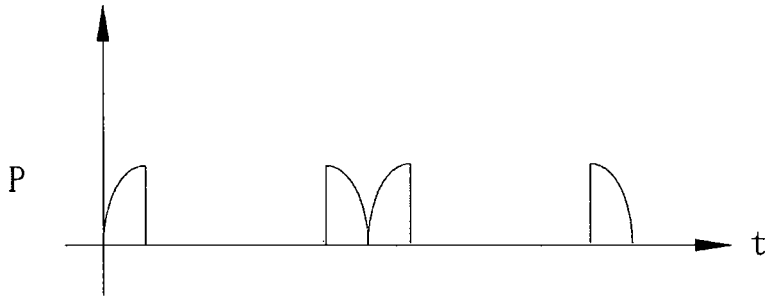
FIG. 7 illustrates a schematic diagram of the reduced power consumption when the holding current circuit of the invention is used.

The holding current circuit 6 of the LED driving apparatus includes the rectifier SCR to switch the transistor MOS on or off. Because the gate of the rectifier SCR is coupled to the node J between the first resistor RA1 and the second resistor RA2, the divided voltage $V_{DIV}$ formed by the first resistor RA1 and the second resistor RA2 dividing the input voltage $V_{IN}$ will be used as a reference voltage for switching the transistor MOS on or off. When the input voltage $V_{IN}$ is higher than a default voltage, the transistor MOS will be switched off and no current will pass through the transistor MOS. That is to say, when the conduction angle of the input voltage $V_{IN}$ becomes larger, the LED driving apparatus will switch the holding current circuit 6 off to reduce unnecessary power consumption, as shown in FIG. 7. After comparing FIG. 7 of the invention with FIG. 5B of prior art, it can be found that the LED driving apparatus of the invention can greatly reduce unnecessary power consumption to achieve the effects of saving power and preventing over-heat.

Figure 8:
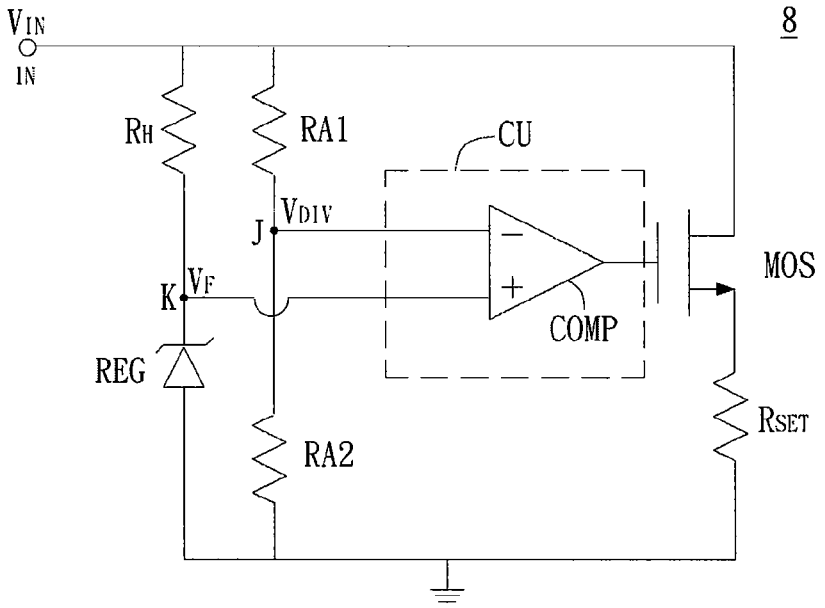
FIG. 8 illustrates a schematic diagram of the holding current circuit of the LED driving apparatus in another embodiment of the invention.

In another embodiment, the holding current circuit of the LED driving apparatus can also use a comparator to switch the transistor MOS on or off. Please refer to FIG. 8. FIG. 8 illustrates a schematic diagram of the holding current circuit of the LED driving apparatus in this embodiment. As shown in FIG. 8, the holding current circuit 8 of the LED driving apparatus includes an input terminal IN, a holding resistor $R_H$, a regulator REG, a first resistor RA1, a second resistor RA2, a setup resistor $R_{SET}$, a transistor MOS, and a comparator COMP. It should be noticed that the comparator COMP is disposed in a control unit CU. Wherein, the transistor MOS can be a metal-oxide-semiconductor field-effect-transistor (MOSFET), but not limited to this. The input terminal IN has an input voltage $V_{IN}$.

The resistor $R_H$ and the regulator REG are coupled in series between the input voltage $V_{IN}$ and the ground terminal. The first resistor RA1 and the second resistor RA2 are coupled in series between the input voltage $V_{IN}$ and the ground terminal. The transistor MOS and the setup resistor $R_{SET}$ are coupled in series between the input voltage $V_{IN}$ and the ground terminal. The two input terminals + and − of the comparator COMP are coupled to a node K between the resistor $R_H$ and the regulator REG and coupled to a node J between the first resistor RA1 and the second resistor RA2. The output terminal of the comparator COMP is coupled to the gate of the transistor MOS. The node J has a divided voltage $V_{DIV}$ formed by the first resistor RA1 and the second resistor RA2 dividing the input voltage $V_{IN}$.

The holding current circuit 8 of the LED driving apparatus includes the comparator COMP to switch the transistor MOS on or off. Because the two input terminals + and − of the comparator COMP are coupled to a node K between the resistor $R_H$ and the regulator REG and coupled to a node J between the first resistor RA1 and the second resistor RA2, the voltage $V_F$ of the regulator REG will be used as the reference voltage of the positive input terminal + of the comparator COMP, and the divided voltage $V_{DIV}$ formed by the first resistor RA1 and the second resistor RA2 dividing the input voltage $V_{IN}$ will be used as the reference voltage of the negative input terminal − of the comparator COMP.

If the compared result of the comparator COMP is that the divided voltage $V_{DIV}$ is higher than the voltage $V_F$ of the regulator REG, the transistor MOS will be switched off and no current will pass through the transistor MOS. That is to say, when the conduction angle of the input voltage $V_{IN}$ becomes larger, the LED driving apparatus will switch the holding current circuit 8 off to reduce unnecessary power consumption, as shown in FIG. 7. After comparing FIG. 7 of the invention with FIG. 5B of prior art, it can be found that the LED driving apparatus of the invention can greatly reduce unnecessary power consumption to achieve the effects of saving power and preventing over-heat.

Figure 9:
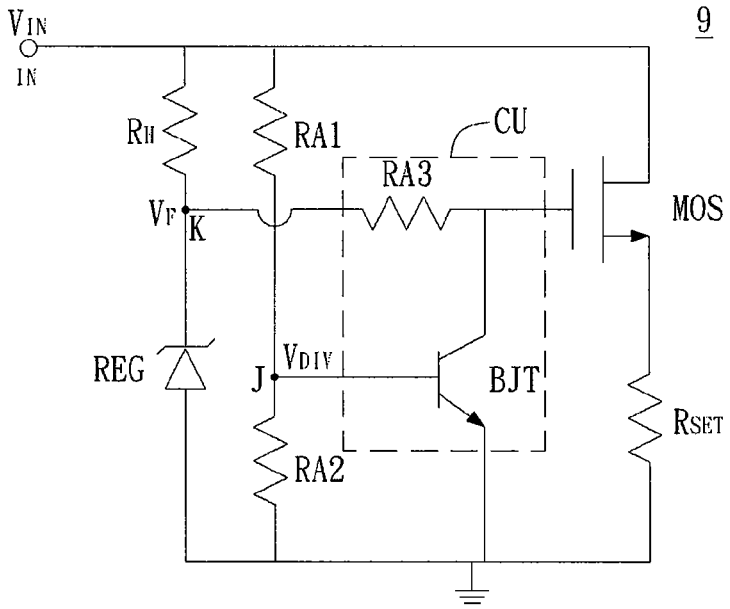
FIG. 9 illustrates a schematic diagram of the holding current circuit of the LED driving apparatus in another embodiment of the invention.

In another embodiment, the holding current circuit of the LED driving apparatus can also use a bipolar junction transistor (BJT) to switch the transistor MOS on or off. Please refer to FIG. 9. FIG. 9 illustrates a schematic diagram of the holding current circuit of the LED driving apparatus in this embodiment. As shown in FIG. 9, the holding current circuit 9 of the LED driving apparatus includes an input terminal IN, a holding resistor $R_H$, a regulator REG, a first resistor RA1, a second resistor RA2, a third resistor RA3, a setup resistor $R_{SET}$, a transistor MOS, and a bipolar junction transistor BJT. It should be noticed that the third resistor RA3 and the bipolar junction transistor BJT are disposed in a control unit CU. Wherein, the transistor MOS can be a metal-oxide-semiconductor field-effect-transistor (MOSFET), but not limited to this. The input terminal IN has an input voltage $V_{IN}$.

The resistor $R_H$ and the regulator REG are coupled in series between the input voltage $V_{IN}$ and the ground terminal. The first resistor RA1 and the second resistor RA2 are coupled in series between the input voltage $V_{IN}$ and the ground terminal. The transistor MOS and the setup resistor $R_{SET}$ are coupled in series between the input voltage $V_{IN}$ and the ground terminal. One end of the third resistor RA3 is coupled to the gate of the transistor MOS and the other end of the third resistor RA3 is coupled to a node K between the holding resistor $R_H$ and the regulator REG. The node K has a voltage $V_F$. The collector of the bipolar junction transistor BJT is coupled between the third resistor RA3 and the gate of the transistor MOS; the emitter of the bipolar junction transistor BJT is coupled to the ground terminal; the base of the bipolar junction transistor BJT is coupled to a node J between the first resistor RA1 and the second resistor RA2. The node J has a divided voltage $V_{DIV}$ formed by the first resistor RA1 and the second resistor RA2 dividing the input voltage $V_{IN}$.

The holding current circuit 9 of the LED driving apparatus includes the bipolar junction transistor BJT to switch the transistor MOS on or off. Because the base of the bipolar junction transistor BJT is coupled to the node J between the first resistor RA1 and the second resistor RA2, the divided voltage $V_{DIV}$ formed by the first resistor RA1 and the second resistor RA2 dividing the input voltage $V_{IN}$ will be used as a reference voltage for switching the transistor MOS on or off. When the input voltage $V_{IN}$ is higher than a default voltage, the transistor MOS will be switched off and no current will pass through the transistor MOS. That is to say, when the conduction angle of the input voltage $V_{IN}$ becomes larger, the LED driving apparatus will switch the holding current circuit 9 off to reduce unnecessary power consumption, as shown in FIG. 7. After comparing FIG. 7 of the invention with FIG. 5B of prior art, it can be found that the LED driving apparatus of the invention can greatly reduce unnecessary power consumption to achieve the effects of saving power and preventing over-heat.

Another embodiment of the invention is a method of operating a LED driving apparatus having a holding current circuit. In this embodiment, the holding current circuit includes an input terminal, a holding resistor, a regulator, a first resistor, a second resistor, a setup resistor, a control unit, and a transistor. The holding resistor and the regulator are coupled in series between the input terminal and a ground terminal. The first resistor and the second resistor are coupled in series between the input terminal and the ground terminal. The transistor and the setup resistor are coupled in series between the input terminal and the ground terminal. The control unit is coupled to the transistor, between the holding resistor and the holding resistor, and between the first resistor and the second resistor respectively.

Figure 10:
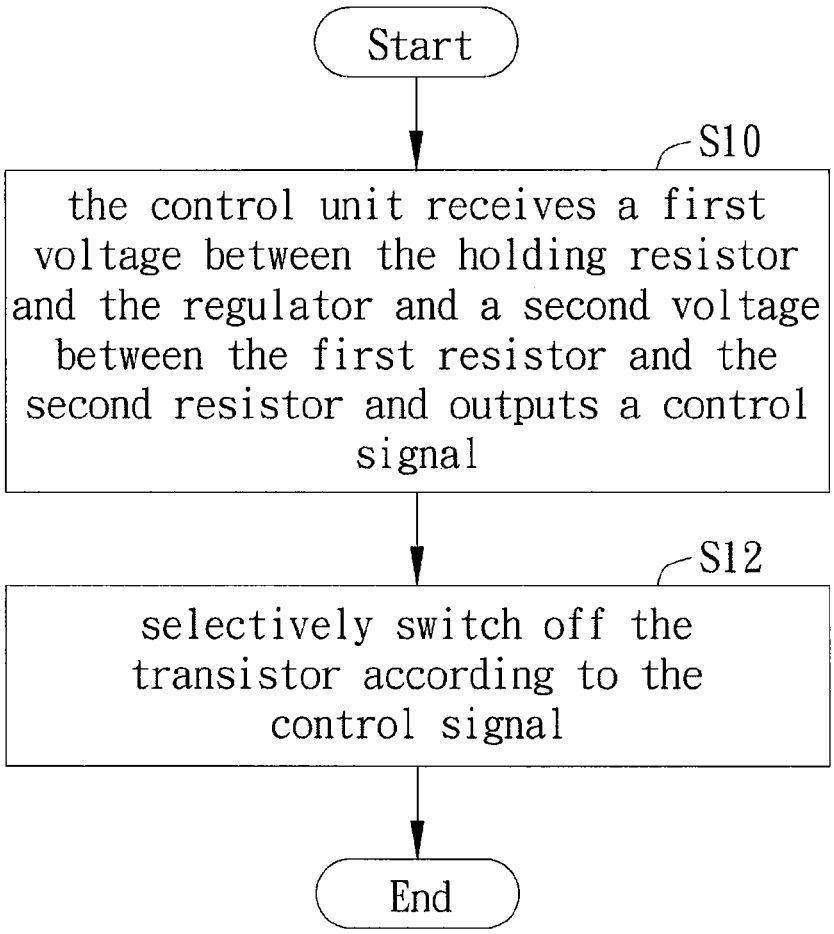
FIG. 10 illustrates a flow chart of the method of operating the holding current circuit of the LED driving apparatus in another embodiment of the invention.

Please refer to FIG. 10. FIG. 10 illustrates a flow chart of the method of operating the holding current circuit of the LED driving apparatus in this embodiment. As shown in FIG. 10, at first, the method performs the step S10, the control unit receives a first voltage between the holding resistor and the regulator and a second voltage between the first resistor and the second resistor and outputs a control signal. Wherein, the first voltage is generated by the regulator, and the second voltage is obtained by the first resistor and the second resistor dividing the input voltage, but not limited to this. Then, the method performs the step S12 to selectively switch off the transistor according to the control signal. When the transistor is switched off, the current will fail to pass through the transistor to solve the problems of high power consumption and over-heat when the input voltage is excessive.

In an embodiment, the control unit can include a third resistor and a rectifier. One end of the third resistor is coupled between the holding resistor and the regulator, and the other end of the third resistor is coupled to a gate of the transistor. The rectifier is coupled between the third resistor and the gate of the transistor, between the first resistor and the second resistor, and to the ground terminal respectively. The rectifier is used to switch the transistor on or off. When the input voltage is higher than a default voltage, the transistor will be switched off and no current will pass through the transistor. That is to say, when the conduction angle of the input voltage becomes larger, the LED driving apparatus will switch the holding current circuit off to reduce unnecessary power consumption.

In another embodiment, the control unit includes a comparator. The two input terminals of the comparator are coupled between the resistor and the regulator and coupled between the first resistor and the second resistor respectively. The output terminal of the comparator is coupled to the gate of the transistor. The comparator is used to switch the transistor on or off. The constant voltage of the regulator will be used as the reference voltage of the positive input terminal of the comparator, and the divided voltage formed by the first resistor and the second resistor dividing the input voltage will be used as the reference voltage of the negative input terminal of the comparator. If the compared result of the comparator is that the divided voltage is higher than the voltage of the regulator, the transistor will be switched off and no current will pass through the transistor. That is to say, when the conduction angle of the input voltage becomes larger, the LED driving apparatus will switch the holding current circuit off to reduce unnecessary power consumption.

In another embodiment, the control unit can include a third resistor and a bipolar junction transistor (BJT). One end of the third resistor is coupled between the holding resistor and the regulator, and the other end of the third resistor is coupled to a gate of the transistor. The BJT is coupled between the third resistor and the gate of the transistor, between the first resistor and the second resistor, and to the ground terminal respectively. The BJT is used to switch the transistor on or off. When the input voltage is higher than a default voltage, the transistor will be switched off and no current will pass through the transistor. That is to say, when the conduction angle of the input voltage becomes larger, the LED driving apparatus will switch the holding current circuit off to reduce unnecessary power consumption.

Compared to the prior art, the LED driving apparatus having the holding current circuit and operating method thereof disclosed by the invention can achieve following effects of: (1) maintaining the input voltage $V_{IN}$ stable at low-voltage conduction angle to prevent the flickering of the LED apparatus; (2) effectively solving the problems of high power consumption and over-heat when the input voltage $V_{IN}$ is excessive in prior arts.

With the example and explanations above, the features and spirits of the invention will be hopefully well described.

Those skilled in the art will readily observe that numerous modifications and alterations of the device may be made while retaining the teaching of the invention. Accordingly, the above disclosure should be construed as limited only by the metes and bounds of the appended claims.

The invention claimed is:

1. A holding current circuit of a LED driving apparatus, comprising:

an input terminal, for receiving an input voltage;

a holding resistor, coupled to the input terminal;

a regulator, coupled between the holding resistor and a ground terminal;

a first resistor, coupled to the input terminal;

a second resistor, coupled between the first resistor and the ground terminal;

a setup resistor, coupled to the ground terminal;

a control unit, coupled to a transistor, between the holding resistor and the regulator, and between the first resistor and the second resistor respectively, for receiving a first voltage between the holding resistor and the regulator and a second voltage between the first resistor and the second resistor and outputting a control signal; and the transistor, coupled to the input terminal, the setup resistor, and the control unit respectively, for receiving the control signal and being selectively switched off by the control signal;

wherein the control unit comprises:

a third resistor, one end of the third resistor is coupled between the holding resistor and the regulator, another end of the third resistor is coupled to a gate of the transistor; and one end of a rectifier or a bipolar junction transistor (BJT), coupled between the third resistor and the gate of the transistor, another end between the first resistor and the second resistor and to the ground terminal respectively.

2. The holding current circuit of the LED driving apparatus of claim 1, wherein the first voltage is generated by the regulator, and the second voltage is obtained by the first resistor and the second resistor dividing the input voltage.

3. The LED driving apparatus of claim 1, wherein the rectifier is a silicon controlled rectifier (SCR).

4. A method of operating a LED driving apparatus having a holding current circuit, the holding current circuit comprising an input terminal, a holding resistor, a regulator, a first resistor, a second resistor, a setup resistor, a control unit, and a transistor, the holding resistor and the regulator coupling in series between the input terminal and a ground terminal, the first resistor and the second resistor coupling in series between the input terminal and the ground terminal, the transistor and the setup resistor coupling in series between the input terminal and the ground terminal, the control unit coupling to the transistor, between the holding resistor and the holding resistor, and between the first resistor and the second resistor respectively, the method comprising steps of:

(a) the control unit receiving a first voltage between the holding resistor and the regulator and a second voltage between the first resistor and the second resistor and outputting a control signal; and (b) selectively switching off the transistor according to the control signal:

wherein the control unit comprises:

a third resistor, one end of the third resistor is coupled between the holding resistor and the regulator, another end of the third resistor is coupled to a gate of the transistor; and one end of a rectifier or a bipolar junction transistor (BJT), coupled between the third resistor and the gate of the transistor, another end between the first resistor and the second resistor and to the ground terminal respectively.

5. The method of claim 4, wherein the first voltage is generated by the regulator, and the second voltage is obtained by the first resistor and the second resistor dividing the input voltage.

* * * * *